US010697095B2

(12) United States Patent
Qiang

(10) Patent No.: US 10,697,095 B2
(45) Date of Patent: Jun. 30, 2020

(54) WOVEN FABRIC

(71) Applicant: DongGuan Shichang Metals Factory Ltd., DongGuan (CN)

(72) Inventor: Song Guo Qiang, Hangzhou (CN)

(73) Assignee: DongGuan Shichang Metals Factory Ltd., DongGuan (CN)

( * ) Notice: Subject to any disclaimer, the term of this patent is extended or adjusted under 35 U.S.C. 154(b) by 1 day.

(21) Appl. No.: 16/046,411

(22) Filed: Jul. 26, 2018

(65) Prior Publication Data

US 2020/0002852 A1 Jan. 2, 2020

(30) Foreign Application Priority Data

Jun. 29, 2018 (CN) ..... 2018 2 1027080 U

(51) Int. Cl.

| | |
|---|---|
| ***D03D 15/00*** | (2006.01) |
| ***D03D 1/00*** | (2006.01) |
| ***A47C 7/26*** | (2006.01) |
| ***D03D 13/00*** | (2006.01) |

(52) U.S. Cl.

CPC ..... *D03D 1/00* (2013.01); *A47C 7/26* (2013.01); *D03D 13/008* (2013.01); *D03D 2700/0137* (2013.01); *D10B 2505/12* (2013.01)

(58) Field of Classification Search

CPC .. D03D 15/00; D03D 15/0027; D03D 1/0017; D03D 1/00; D03D 13/004; D03D 13/008; D03D 15/0061; D03D 15/0077; D03D 2700/0177; D10B 2201/02; D10B 2201/04; D10B 2331/04; D10B 2503/02; D10B 2503/06; D10B 2501/00; A47G 11/001; A47G 11/003; A47G 23/0303; Y10T 442/3268

See application file for complete search history.

(56) References Cited

U.S. PATENT DOCUMENTS

| | | | |
|---|---|---|---|
| D10,136 | S | 7/1877 | Perry |
| D58,860 | S | 8/1921 | Worms |
| D107,651 | S | 12/1937 | Klein |
| D112,556 | S | 12/1938 | Weisberger |
| D113,096 | S | 1/1939 | Staines |
| D116,675 | S | 9/1939 | Walther |
| D116,735 | S | 9/1939 | Bry |
| D117,410 | S | 10/1939 | Wershing |
| D117,548 | S | 11/1939 | Feldman |
| D121,578 | S | 7/1940 | Sokolofl |
| D123,964 | S | 12/1940 | Sumerfield |
| 2,253,374 | A | 8/1941 | Haskell |
| D133,938 | S | 9/1942 | Lord |

(Continued)

FOREIGN PATENT DOCUMENTS

| | | | |
|---|---|---|---|
| CN | 202730383 U | * | 2/2013 |
| CN | 202730383 U | | 2/2013 |

(Continued)

*Primary Examiner* — Robert H Muromoto, Jr.

(74) *Attorney, Agent, or Firm* — Luedeka Neely Group, P.C.

(57) ABSTRACT

A woven fabric for seats is made of warps and wefts woven into a pattern with a ratio of 1:1, wherein the warps density is 8 strips per unit length and the wefts density is 9.2 strips per unit length. The warps and wefts are both made of polyester and linen, wherein the polyester comprises 94% by weight and the linen comprises 6% by weight.

5 Claims, 2 Drawing Sheets

(56) References Cited

U.S. PATENT DOCUMENTS

| | | | | |
|---|---|---|---|---|
| D161,221 | S | 12/1950 | Walther | |
| 2,574,375 | A | 11/1951 | Dave | |
| 3,485,706 | A | 12/1969 | Evans | |
| 3,922,888 | A | 12/1975 | Patterson | |
| 4,342,802 | A | 8/1982 | Pickens, Jr. et al. | |
| D287,433 | S | 12/1986 | Ellers | |
| 4,671,983 | A | 6/1987 | Burt | |
| D341,944 | S | 12/1993 | Peter | |
| 5,458,950 | A | 10/1995 | Bredenick et al. | |
| 5,487,936 | A * | 1/1996 | Collier | D03D 15/00 428/903 |
| D367,766 | S | 3/1996 | Makoui et al. | |
| 5,707,903 | A | 1/1998 | Schottenfeld | |
| 6,136,413 | A | 10/2000 | Port et al. | |
| 6,251,207 | B1 | 6/2001 | Schultz et al. | |
| D465,337 | S | 11/2002 | Curtis et al. | |
| D511,251 | S | 11/2005 | Wong | |
| 7,169,458 | B2 | 1/2007 | Underhill et al. | |
| D707,974 | S | 7/2014 | Blackford | |
| 10,145,035 | B2 * | 12/2018 | Goldberg | D03D 13/008 |
| 2002/0094404 | A1 | 7/2002 | Schottenfeld | |
| 2012/0015155 | A1 | 1/2012 | Blackford et al. | |
| 2012/0208416 | A1 | 8/2012 | Lerman | |
| 2013/0209749 | A1 | 8/2013 | Myangiro et al. | |
| 2015/0140240 | A1 | 5/2015 | Pleyber et al. | |
| 2017/0086615 | A1 * | 3/2017 | Alanen | D03D 1/00 |

FOREIGN PATENT DOCUMENTS

| | | | | |
|---|---|---|---|---|
| CN | 103361847 | A * | 10/2013 | |
| CN | 103668708 | A * | 3/2014 | |
| CN | 103668708 | A | 3/2014 | |
| CN | 104248100 | A * | 12/2014 | |
| CN | 105666986 | A * | 6/2016 | |
| CN | 108286193 | A * | 7/2018 | |
| GB | 1034651 | A * | 6/1966 | D03D 1/00 |
| WO | WO-2015128883 | A2 * | 9/2015 | |

* cited by examiner

WOVEN FABRIC

FIELD

This invention relates to the field of fabrics. More particularly, this invention relates to a woven fabric for seats, such as seats for furniture.

BACKGROUND

At present, fabrics used in automobile seats, furniture seats and so on are mostly linen fabrics or cotton-linen fabrics. As people sit down on, get up from, and generally move around on a seat during daily use, it is inevitable that there is friction between the fabric on the surface of the seat and people's clothing. Due to such friction, typical seat fabrics made of linen or cotton are easily deformed or even torn. When the seat fabric is exposed to such wear over time, a fuzz or fluff develops that affects the aesthetics of the fabric.

Therefore, a high-strength, tear-resistant, and fuzz-resistant fabric is needed for seats.

SUMMARY

Embodiments described herein provide a fabric for seats with the characteristics of high strength, tear resistance, prolonged service life, and reduced deformation and fuzzing after prolonged use.

To achieve the above-listed advantages, the technical solution adopted by the present disclosure provides a fabric for seats, which is made of warps and wefts that are woven into a pattern with a ratio of 1:1, wherein the warps density is 8 strips/cm and the wefts density is 9.2 strips/cm.

As a further improvement of the above technical solution, the surface density of the fabric is 320 grams per square meter.

As a further improvement of the above technical solution, the warps and the wefts are both made of polyester and linen, where the polyester comprises 94% of the fabric by weight and the linen comprises 6% by weight.

As a further improvement of the above technical solution, the back surface of the fabric is coated with wool.

The fabric according to the present disclosure has the following advantages:

- It is stronger and more compact when compared to conventional products.
- It can be in black, gray, or in other different color combinations.
- It has a certain aesthetic effect.
- It is weaved by warps and wefts, both of which are made of polyester and linen.
- It has high strength and wear resistance, and it is difficult to deform, which prolongs the service life of the fabric.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

The following is a detailed description of the best mode or modes of the invention presently contemplated. Such description is not intended to be understood in a limiting sense, but to be an example of the invention presented solely for illustration thereof, and by reference to which one skilled in the art may be advised of the advantages and construction of the invention. Reference will now be made in detail to a preferred implementation of the present invention as illustrated in the accompanying drawing. Wherever possible, the same reference numbers will be used throughout the drawings to refer to the same or like parts.

As the terms are used herein, "warp" and "weft" are the two basic components used in weaving to turn thread or yarn into fabric. For example, lengthwise or longitudinal warp threads may be held stationary in tension on a frame or loom while the transverse weft thread is drawn through and inserted over-and-under the warp threads.

Figure 1:
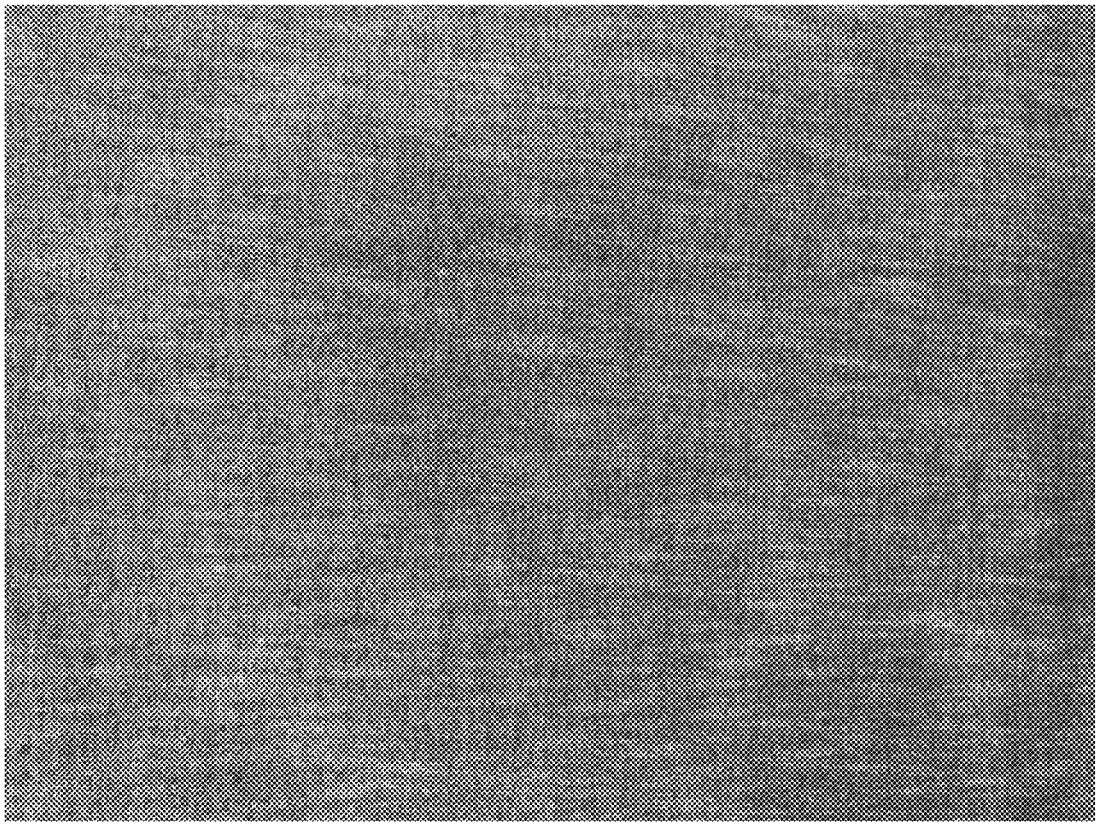
FIGS. 1, 2, and 3 depict a woven fabric according to an embodiment of the invention from three different viewing distances.
Figure 2:
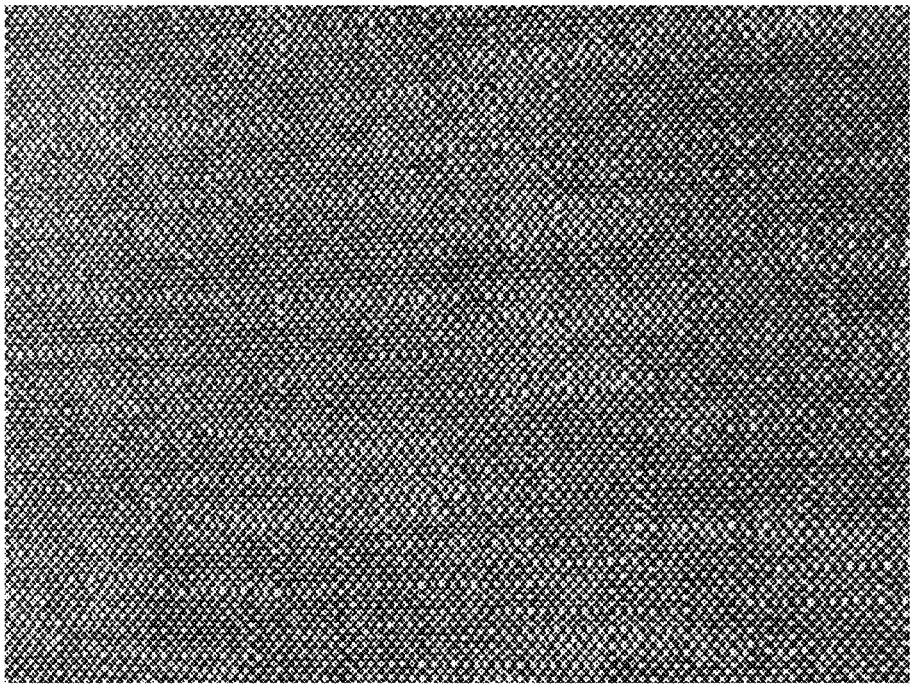
Figure 3:
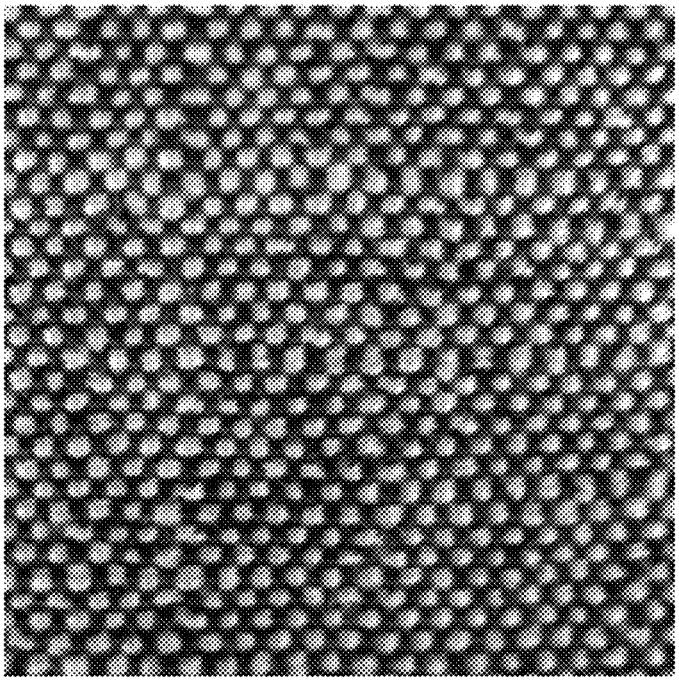
Figure 4:
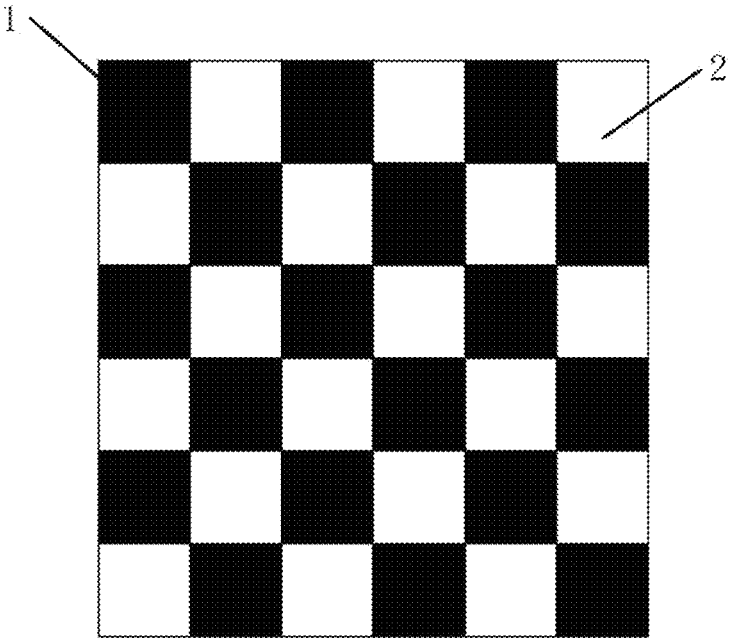
FIG. 4 depicts a schematic diagram of the structure of the woven fabric depicted in FIGS. 1, 2, and 3 according to an embodiment of the invention.

FIGS. 1-4 depict an embodiment of a woven fabric for seats. The fabric is made of a woven pattern of warps 1 and wefts 2. The warps 1 and the wefts 2 are preferably woven into a pattern with a ratio of substantially 1:1. In an exemplary embodiment, such pattern could be a square interlaced pattern, such as in black and gray (with warps in black and wefts in gray, or vice-verse), or in other different color combinations. The warps density is preferably 8 strips/cm and the wefts density is preferably 9.2 strips/cm. The surface density of a preferred embodiment of the fabric is 320 grams per square meter.

The warps 1 and the wefts 2 are preferably both made of polyester and linen, where the polyester comprises 94% by weight of the fabric and the linen comprises 6% by weight of the fabric. This composition provides tear-resistance, non-deformation, and prolonged service life of the fabric.

In preferred embodiments, the back of the fabric can be coated with wool to further protect and improve the strength of the fabric.

In preferred embodiments, the warps 1 and the wefts 2 of the fabric are colored at high temperature to provide higher color fastness compared to a fabric made of cotton and linen.

The use of any and all examples, or exemplary language (e.g., "such as") provided herein, is intended merely to better illuminate embodiments of the present disclosure and does not pose a limitation on the scope of the present disclosure unless otherwise claimed. No language in the specification should be construed as indicating any non-claimed element as essential to the practice of the present disclosure.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A woven fabric comprising a pattern of warps and wefts wherein the warps have a density of 8 strips per centimeter and comprise 94% by weight polyester and 6% by weight linen, and the wefts have a density of 9.2 strips per centimeter, and comprise 94% by weight polyester and 6% by weight linen.

2. The woven fabric according to claim 1 having a surface density of 320 grams per square meter.

3. The woven fabric according to claim 1, wherein a backing applied to of the fabric comprises wool.

4. A woven fabric comprising:

warps made of polyester and linen and woven at a density of 8 strips per centimeter; and wefts made of polyester and linen and woven at a density of 9.2 strips per centimeter, wherein the polyester comprises 94% by weight of the woven fabric, and the linen comprises 6% by weight of the woven fabric, and wherein a surface density of the woven fabric is 320 grams per square meter.

5. The woven fabric according to claim 4, wherein a backing applied to the fabric comprises wool.

* * * * *